US006220197B1

(12) United States Patent
Pohlman

(10) Patent No.: US 6,220,197 B1
(45) Date of Patent: Apr. 24, 2001

(54) ANCHORING AND OPERATING DEVICE FOR A WATERCRAFT

(76) Inventor: Fred Pohlman, R.R. #1, Box 30, Golden Eagle, IL (US) 62030

( * ) Notice: Subject to any disclaimer, the term of this patent is extended or adjusted under 35 U.S.C. 154(b) by 0 days.

(21) Appl. No.: 09/651,267

(22) Filed: Aug. 30, 2000

(51) Int. Cl.[7] ..... B63B 21/24
(52) U.S. Cl. ..... 114/294; 440/36
(58) Field of Search ..... 440/36; 114/230.1, 114/294, 295, 293; 52/155, 156, 165; 173/128, 132

(56) References Cited

U.S. PATENT DOCUMENTS 415,501 * 11/1889 Cole ..... 440/36
2,526,871 * 10/1950 Johnson .
2,536,908 * 1/1951 Chadwick .
2,552,424 * 5/1951 Gorman .
2,706,959 * 4/1955 Downs .
2,907,294 * 10/1959 Lawler .
2,917,851 * 12/1959 Ellicott, Jr. ..... 440/36
2,987,030 * 6/1961 Jean, Jr. .
3,238,912 * 3/1966 Perlick .
3,626,887 * 12/1971 Norman .
3,693,569 * 9/1972 Chauvin .

* cited by examiner

*Primary Examiner*—Ed Swinehart

(57) ABSTRACT

A device for operating and anchoring a watercraft in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole.

21 Claims, 3 Drawing Sheets

ANCHORING AND OPERATING DEVICE FOR A WATERCRAFT

BACKGROUND OF THE INVENTION

The use of fishing boats or marine vessels in shallow water or along the edge of the shoreline goes hand in hand with the success of a fishing effort. For the same reason, fish harbor in the brush or along the shoreline, larger fish prey on smaller fish near these hiding places. When fishing in these areas, the operator of the boat must be able to maneuver the boat without hitting the brush and follow the indications provided by a fishfinder.

A trolling motor is the most common means of navigating in shallow or hazardous water at a slow speed but fails to provide any provisions for stopping the boat. If a boat is taken near the shoreline for fishing, the trolling motor makes the boat sail, often into the shoreline damaging the boat or quickly through schools of fish. Stumps often provide the most hazardous damage to boats and are capable of damaging the trolling motor as well.

Some of the earliest means for operating the boat on a waterway was provided by men using long poles to push off the river bed to move the boat along the waterway. Such poles are also well known to provide a means for breaking boats or docking a boat. Nevertheless, there exists a need for operating and stopping boats in hazardous waterways for recreational use.

SUMMARY OF THE INVENTION

The present invention is directed to a device for operating and anchoring a watercraft in water areas with brush, stumps, in shallow areas, and along shoreline.

It is an object of the present invention to provide a device which is attachable to a watercraft and has an adjustable universally operated pole that may be locked into anchoring position.

It is another object of the present invention to provide and operating and anchoring device for a boat used for fishing in congested areas.

Another object of the present invention is to provide a device for quickly anchoring a watercraft for fishing in a congested area.

Still another object of the present invention is to provide a device for operating a boat in a congested areas and then anchoring the boat.

Yet another object of the present invention is to provide a device for quickly moving and anchoring a boat in a congested area.

The present invention provides the operator of a watercraft with a device for operating the watercraft in hazardous areas without the need of a trolling motor and without damaging the boat. The device includes an easy to operate spud assembly which includes a bracket that may be retrofitted onto any watercraft already in use. The spud assembly permits the operator to immediately stop the watercraft for temporary anchoring or long term anchoring. The spud assembly also permits the operator to walk the watercraft around brush piles in the water, along shorelines, in shallow water or through pilings.

DETAILED DESCRIPTION OF THE INVENTION

Figure 1:
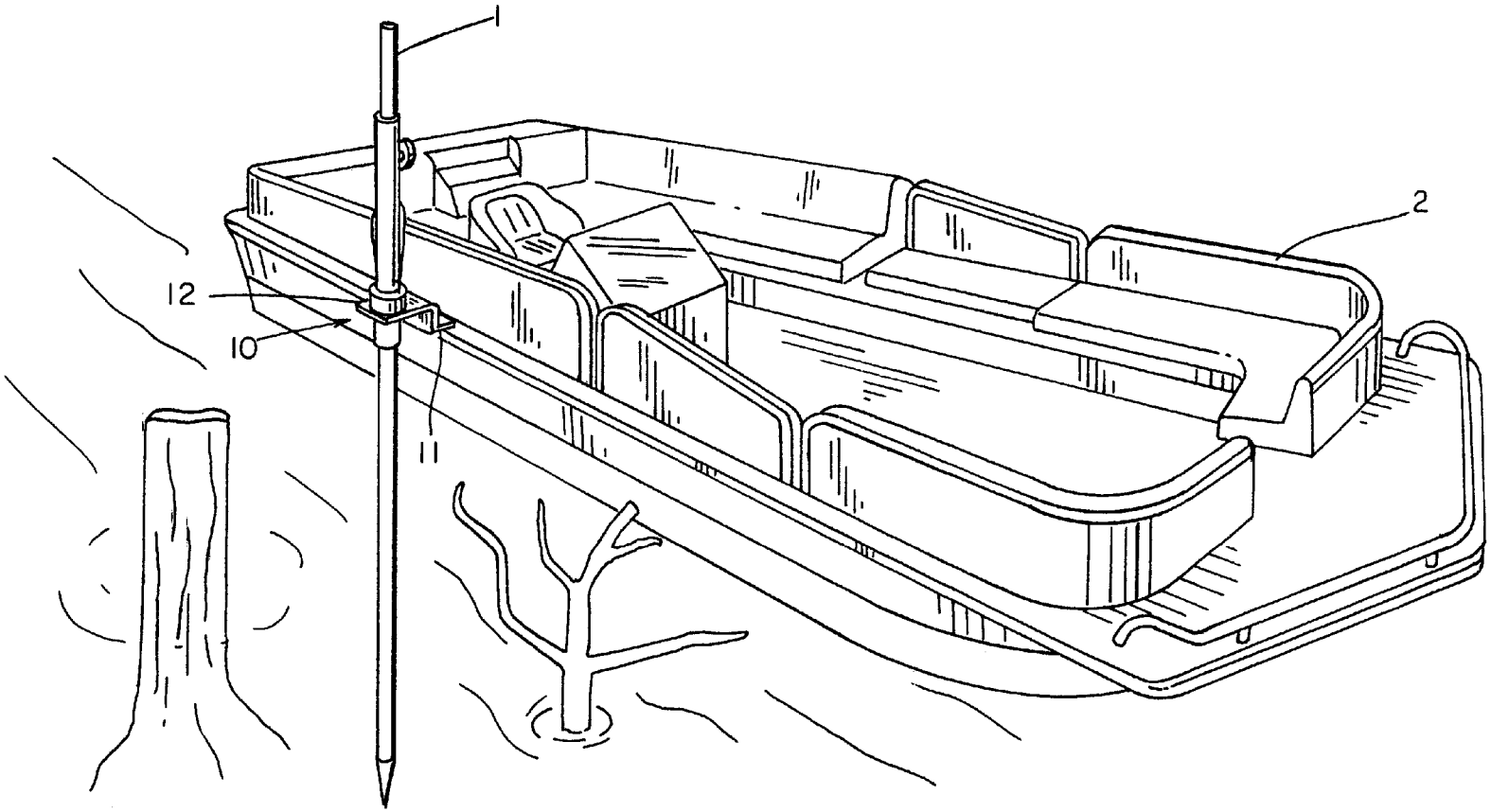
FIG. 1 is a plan view of a device for operating and anchoring a watercraft.

A device 1 for operating and anchoring a watercraft 2 on a body of water is illustrated in FIG. 1. Although the device is mounted on the watercraft shown in FIG. 1, the device may be adopted to mount on any similar type of watercraft. The device is used on small boats, such as fishing boats, in areas where trolling motors and drag anchors fail to provide the needed mobility and quick stopping ability. Hazardous areas near the shore on lakes and rivers often include brush piles, stumps, and rocks which could put a hole in a boat hull or damage a motor, even a trolling motor.

Figure 2:
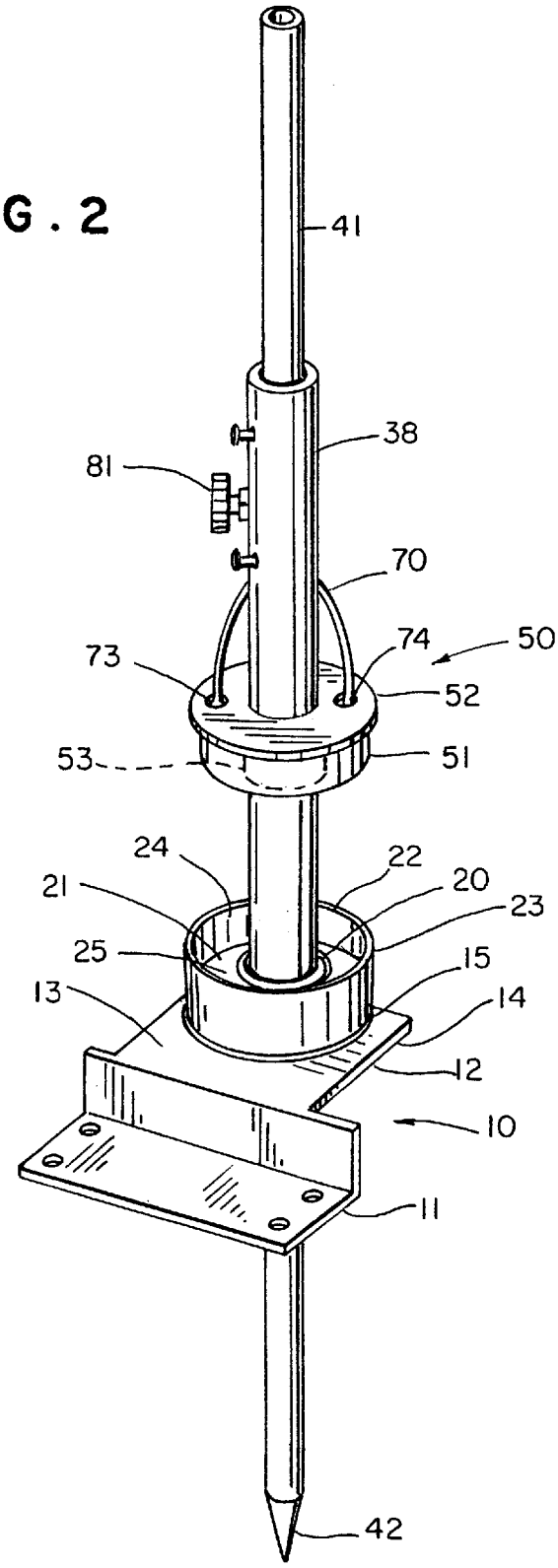
FIG. 2 is a top plan view a device for operating and anchoring a watercraft.

The present invention solves all the problems of operating a boat or watercraft in hazardous shallow water or along a shoreline. As shown in FIG. 2, the device 1 includes a bracket 10 with a pair of mounting flanges 11 and 12. First mounting flange 11 includes four apertures for mounting the bracket 10 to the side of the boat 2 with any well known fastening device. The first mounting flange 11 has an L-shaped configuration as shown in the drawings. Second mounting flange 12 is welded to the first mounting flange 11 or may be integrally formed of the same material such as steel or iron. As assembled and as illustrated in FIG. 1, first mounting flange 11 is connected to the boat and the second mounting flange 12 extends over the water.

The second mounting flange 12 includes a top surface 13, a bottom surface 14 and a central opening 15. Positioned on the top surface 13 over the central opening 15 of the second mounting flange 12 is a spud assembly 20. The spud assembly 20 includes a maneuvering housing 21 and a lock retaining cup 22. The lock retaining cup 22 has an outer radial wall 23, an inner radial wall 24, a bottom wall 25 and a central opening 26. The lock retaining cup 22 is welded to the maneuvering housing 21. The maneuvering housing 21 is formed by an upper flangette 27 and a lower flangette 28, each having central openings 29, 30 and central flanges 32, 33. Each central flange is cupped at one end and the flangettes are welded back to back with each respective flange facing in the opposite direction to form an outer housing 35 for receiving a maneuvering ring 36. The maneuvering ring 36 is rotatably and universally supported for movement within the outer housing 35. The maneuvering ring 36 has a central aperture 37 for receiving an operating cylinder 38. The operating cylinder 38 is about two to three feet long and includes an outer surface 39 and an inner surface 40. The operating cylinder 38 is securely connected to the maneuvering ring 36 for rotational and universal movement in union with the maneuvering ring 36 inside the outer housing.

Adjustably positioned within the operating cylinder is a pole 41. The pole 41 is preferably at least 15 feet long and is inserted through the inside of the operating cylinder. The pole is used for moving the operating cyclinder and accordingly operating the boat along the water. The pole may be made of any heavyweight material and could be constructed of telescoping sections for compact storage. The pole is positioned through the operating cylinder so that both ends of the pole 41 extend outside of the assembly. Top portion 42 of the pole includes a flatten section 43 and bottom end 44 of the pole is formed to dig into the ground below the water. The bottom end of the pole may be provided with other shapes or even attachments shapes depending on the underwater terrain.

In order to anchor the boat, a locking means 50 is provided for locking the maneuvering ring 36, the operating cylinder 38, and the pole 41 within the spud assembly 20. The locking means 50 includes a lock 51 and a lock housing 52. The lock housing 52 has a central cylindrical section 53, an outer cylindrical section 54, and a top washer section 55. Each of the sections has a central opening 56, 57, 58. The central cylindrical section 53 has an upper member 59 which is welded to bottom surface 60 of the top washer section 55. The outer cylindrical section 54 has an outer wall surface 61 and an upper top portion 62 which also welded to the bottom surface 60 of the top washer section 55. The diameter of the central opening 56 of the central cylindrical section 53 is slightly larger than the outer diameter of the operating cylinder 38. The locking means 50 is slidably supported on the operating cylinder 38 by positioning the central cylindrical section 53 along the outer surface 39 of the operating cylinder 38. The outside diameter of the outer cylindrical section 54 is slightly smaller than the inside diameter of the inner radial wall 24 of the retaining cup.

The locking means 50 has an operating means 70 for locking and unlocking the spud assembly 20. The operating means 70 includes a cord 71 secured to the lock housing 51 through apertures 73 and 74 in the top washer section 55. The locking means 50 is removed from the spud assembly by pulling on the cord.

Figure 5:
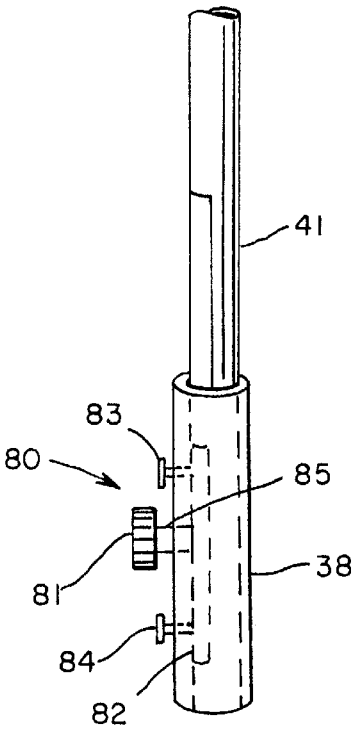
FIG. 5 is a partial view of FIG. 1.
Figure 4:
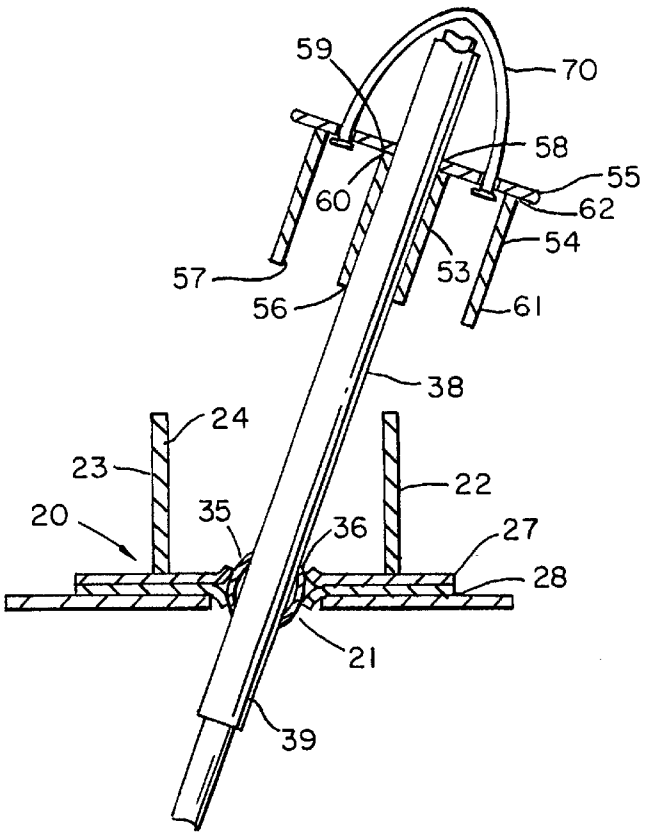
FIG. 4 is an partial cross sectional of the device shown in FIG. 3 in an unlocked position.
Figure 3:
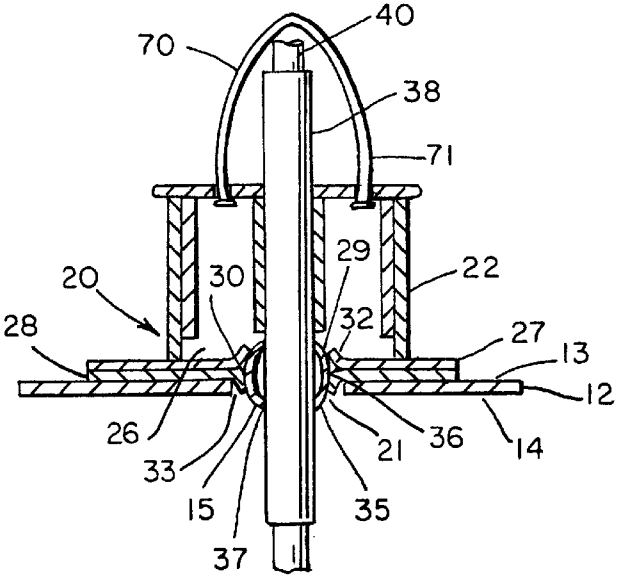
FIG. 3 is a partial cross sectional view taken along lines 2—2 of FIG. 2.

As shown in FIG. 5, a set screw and clamp assembly 80 is used to secure the pole against the inside surface of the operating cylinder. The assembly 80 includes a set screw 81, a clamp 82 and a pair of stops 83 and 84. The set screw 81 is turned to push the clamp 82 against the flatten section of the pole and wedge the pole against the inside surface of the operating cylinder to prevent movement of the pole . The stops limit movement of the clamp against the pole to prevent over tightening. The set screw 81 is positioned in an opening 85 in the operating cylinder 38 to limit vertical and horizontal movement of the pole when needed. The set screw 81 may be tightened or loosened to position the pole at a selected height or depth.

In order to operate the device in hazardous or shallow water, the locking means is released by pulling on the cord 71 and releasing the set screw and clamp. The pole is then dropped to the bottom and used to move the boat in the water. After selecting a stopping point, the locking means is inserted into the locking cup until the central cylindrical section 53 contacts the maneuvering locking movement of the maneuvering, the operating cylinder and the pole.

The operator or fisherman may use the device to operate a boat in water areas with brush or along shorelines. As fish are spotted with a fishfinder the user may release the locking means 50 to drop the pole to the bottom and walk the boat to the fish. The boat may then be anchored directly over the fish without drifting problems. If the boat must be moved a few feet, the locking means may be released and quickly reinserted whenever the user sets the pole in the bed or bottom.

What is claimed is:

1. A device for operating and anchoring a watercraft, said device comprising:

a bracket, said bracket adopted to be connected to said watercraft, a maneuvering ring, said maneuvering ring rotatably and universally mounted in a maneuvering ring housing, said maneuvering ring housing mounted on said bracket, an operating cylinder, said operating cylinder mounted within said maneuvering ring for rotational and universal movement with said maneuvering ring, a pole, said pole mounted within said operating cylinder for operating said cyclinder within said maneuvering ring, and locking means, said locking means having a cord for inserting and withdrawing said locking means from said maneuvering ring housing to lock and limit movement of said operating cylinder in said maneuvering ring.

2. The device for operating and anchoring a watercraft as recited in claim 1, said device further comprising a set screw and clamp assembly, said set screw and clamp assembly including a set screw for locking a clamp against said pole within said operating cylinder to limit movement of said pole.

3. The device for operating and anchoring a watercraft as recited in claim 2, said device further comprising a outer housing, said outer housing mounted in said maneuvering ring housing for supporting said maneuvering ring.

4. The device for operating and anchoring a watercraft as recited in claim 1, said device further comprising a pair of stops on said operating cylinder for limiting movement of said clamp against said pole.

5. The device for operating and anchoring a watercraft as recited in claim 1, said locking means comprising a locking cup connected to said maneuvering ring housing.

6. The device for operating and anchoring a watercraft as recited in claim 1, said locking means comprising a central cylindrical section for locking said maneuvering ring against movement.

7. The device for operating and anchoring a watercraft as recited in claim 1, said pole having a flat side for positioning aid clamp against said pole.

8. A device for operating and anchoring a watercraft on a body of water having a bottom bed of less than 15 feet from the surface of the water, said device including a pole no greater than 15 feet long, said device comprising:

a locking means for locking said pole in said bracket, and a maneuvering ring housing, said maneuvering ring housing having a maneuvering ring rotatably and universally supporting said pole, said pole operable within said maneuvering ring for universal movement to move said watercraft on the body of water and anchor said watercraft on the body of water by thrusting said pole into the bottom bed.

9. The device for operating and anchoring a watercraft as recited in claim 8, said device further comprising a set screw and clamp assembly, said set screw and clamp assembly including a set screw for locking a clamp against said pole within said operating cylinder to limit movement of said pole.

10. The device for operating and anchoring a watercraft as recited in claim 8, said device further comprising a outer housing and an operating cylinder, said outer housing mounted in said maneuvering ring housing for supporting said maneuvering ring.

11. The device for operating and anchoring a watercraft as recited in claim 10, said device further comprising a pair of stops on said operating cylinder for limiting movement of said clamp against said pole.

12. The device for operating and anchoring a watercraft as recited in claim 8, said locking means comprising a locking cup connected to said maneuvering housing.

13. The device for operating and anchoring a watercraft as recited in claim 8, said locking means comprising a central cylindrical section for locking said maneuvering ring against movement.

14. The device for operating and anchoring a watercraft as recited in claim 8, said pole having a flat section for positioning said clamp against said pole.

15. A device for operating and anchoring a watercraft on a body of water having a bottom bed of less than 15 feet from the surface of the water, said device including a pole no greater than 15 feet long, said device comprising:

a maneuvering ring housing, a maneuvering ring, said maneuvering ring rotationally supported in said maneuvering ring housing, an operating cylinder, said operating cylinder connected to said maneuvering ring for movement with said maneuvering ring, and a locking means for locking said maneuvering ring and said operating cylinder, and said pole, said pole operable within said maneuvering ring for universal movement to move said watercraft on the body of water and anchor said watercraft on the body of water by thrusting said pole into the bed bottom.

16. The device for operating and anchoring a watercraft as recited in claim 15, said device further comprising a set screw and clamp assembly, said set screw and clamp assembly including a set screw for locking a clamp against said pole within said operating cylinder to limit movement of said pole.

17. The device for operating and anchoring a watercraft as recited in claim 15, said device further comprising a outer housing, said outer housing mounted in said maneuvering ring housing for supporting said maneuvering ring.

18. The device for operating and anchoring a watercraft as recited in claim 15, said device further comprising a pair of stops on said operating cylinder for limiting movement of said clamp against said pole.

19. The device for operating and anchoring a watercraft as recited in claim 15, said locking means comprising a locking cup connected to said maneuvering ring housing.

20. The device for operating and anchoring a watercraft as recited in claim 15, said locking means furtherer comprising a central cylindrical section for locking said maneuvering ring against movement.

21. The device for operating and anchoring a watercraft as recited in claim 16, said pole having a flat side for positioning said clamp against said pole.

* * * * *